US009051040B2

(12) United States Patent
Kuriyagawa et al.

(10) Patent No.: US 9,051,040 B2
(45) Date of Patent: Jun. 9, 2015

(54) OUTBOARD ENGINE UNIT

(71) Applicant: HONDA MOTOR CO., LTD, Tokyo (JP)

(72) Inventors: Koji Kuriyagawa, Wako (JP); Yoshiyuki Matsuda, Wako (JP); Hajime Yoshimura, Wako (JP); Nobuchika Katagiri, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 43 days.

(21) Appl. No.: 13/927,623

(22) Filed: Jun. 26, 2013

(65) Prior Publication Data

US 2014/0057507 A1 Feb. 27, 2014

(30) Foreign Application Priority Data

Aug. 21, 2012 (JP) ..... 2012-182217
Aug. 21, 2012 (JP) ..... 2012-182257

(51) Int. Cl.

| | |
|---|---|
| ***F02B 61/04*** | (2006.01) |
| ***B63H 20/14*** | (2006.01) |
| ***B63H 20/32*** | (2006.01) |
| ***B63H 20/28*** | (2006.01) |
| ***F01P 3/20*** | (2006.01) |

(52) U.S. Cl.

CPC ..... *B63H 20/14* (2013.01); *B63H 20/28* (2013.01); *F01P 3/202* (2013.01)

(58) Field of Classification Search

CPC ..... F01P 2060/045; F01P 2050/02
USPC ..... 440/88 C, 88 D, 88 T, 88 G, 75, 77, 89 R, 440/88 M

See application file for complete search history.

(56) References Cited

U.S. PATENT DOCUMENTS

| | | | | |
|---|---|---|---|---|
| 5,873,755 | A * | 2/1999 | Takahashi et al. | 440/77 |
| 6,537,116 | B2 * | 3/2003 | Nakata et al. | 440/88 G |
| 2009/0163093 | A1 * | 6/2009 | Fukuoka | 440/88 M |

FOREIGN PATENT DOCUMENTS

JP 2010-221754 A 10/2010

* cited by examiner

*Primary Examiner* — S. Joseph Morano
*Assistant Examiner* — Andrew Polay
(74) *Attorney, Agent, or Firm* — Westerman, Hattori, Daniels & Adrian, LLP

(57) ABSTRACT

An outboard engine unit includes a water pump disposed on a lower end portion of an input shaft of a transmission, and left and right cooling water feeding passages interconnecting the water pump and a cooling water inlet of an engine. The left and right cooling water feeding passages are disposed around a plurality of transmission gears disposed on the input shaft of the transmission. A cooling water drawn by the water pump is guided through the left and right cooling water feeding passages to the cooling water inlet.

10 Claims, 14 Drawing Sheets

10
11
22
52
55
54
55
54
55
23
51
53
21
148
147
26c
15
127a
17
127
128
26a
11
11
33
67
135
12
4
4
77
64
26
34
72
13
3
67a
63
62
25
16
68
26b
61
65
8
8
68a
122
44
31
35
69
26d
132
27
27b
45
27c
37
131
42
155
41
47
38
36

6
9
7
5
10
26a
67d
26
101
62
61a
26b
94
102
96
122
31
65
26d
106a
106
105
105a
27d
108
67c
107
128
127
27e
67b
64
88
63
95
69a
27b
77
27a
44
82
113
67e
84(84)
27
85(85)
69
33
73a
73
72
67g
68b
68
112
111
68a
112a
67
61b
61
35

148
147
127a
127
128
10
135
33
151
34
77
67b
133a(134a)
142
86
67e
72
31
82
61a(61d)
67
113
111
141(144)
67g
112
26
61
61b
126
68b
26b
133(134)
68
25
122b
27a
122
44
123
27d
122a
27
27b
158
132
41
156
45
27c
37
157
137
131
H1
155
35a
139
138
35
38
36
47

14

OUTBOARD ENGINE UNIT

FIELD OF THE INVENTION

The present invention relates to an outboard engine unit having a transmission having an input shaft connected to an engine and an output shaft connected via a bevel gear mechanism to a propeller shaft.

BACKGROUND OF THE INVENTION

An outboard engine unit of the above type is well known in the art (see, for example, JP-A-2010-221754). The outboard engine unit includes a transmission interconnecting a crankshaft of an engine and a propeller and having an output shaft carrying a water pump thereon. The outboard engine unit also includes an engine-cooling system and a transmission-cooling system disposed separately from the engine-cooling system. The water pump is driven by the output shaft of the transmission to draw water from an outside of the outboard engine unit and then pump out the water to the engine for cooling the engine. The engine is cooled by the engine-cooling system and the transmission is cooled by the transmission-cooling system.

In the outboard engine unit disclosed in JP-A-2010-221754, an output shaft of a transmission undergoes forward rotation during forward propulsion of a hull and reverse rotation during reverse propulsion of the hull. The output shaft of the transmission stops its rotation during stop of the hull. Where the water pump is disposed on the output shaft of the transmission, the water pump cannot pump out a cooling water to an engine for cooling the engine during the reverse propulsion or stop of the hull.

To address this problem, it is suggested that the water pump be disposed separately from the output shaft of the transmission, that is, the water pump be disconnected from the output shaft, in which case the water pump may be connected through a drive mechanism to an input shaft of the transmission. Since the input shaft of the transmission continues forward rotation, the water pump can be driven to feed a cooling water to the engine even during reverse propulsion or stop of the hull, as in the case of forward propulsion of the hull. However, where the water pump is disposed separately from the output shaft of the transmission, a part for attaching the water pump separately from the output shaft of the transmission or a drive mechanism for connecting the water pump to the input shaft of the transmission is required. As a result, the number of parts of the outboard engine unit would increase and hence the weight of the outboard engine unit would increase.

In the outboard engine unit, the transmission transmits rotation of an engine crankshaft to a propeller shaft in such a manner as to adjust propulsion of the hull.

Since the outboard engine unit includes the transmission, however, the outboard engine unit is required to have not only an engine-cooling system but also a transmission-cooling system separate from the engine-cooling system. The two systems, that is, the engine-cooling system and the transmission-cooling system in the outboard engine unit make a structure of the engine-cooling system complicated and hence cost reduction of the outboard engine unit difficult.

SUMMARY OF THE INVENTION

In view of the foregoing prior art problems, an object of the present invention is to provide an outboard engine unit capable of feeding a cooling water from a water pump to an engine during reverse propulsion or stop of a hull without requiring increase in the number of parts and weight of the outboard engine unit, the outboard engine unit having a simple structure to cool a transmission.

According to one aspect of the present invention, there is provided an outboard engine unit including an engine, a transmission, and a propeller shaft, the transmission having an input shaft connected to the engine and an output shaft connected to the propeller shaft, the outboard engine unit comprising: a water pump disposed on a lower end portion of the input shaft for drawing a cooling water from an outside of the outboard engine unit; and a plurality of cooling water feeding passages interconnecting the water pump and a cooling water inlet of the engine for directing the cooling water drawn by the water pump to the cooling water inlet, wherein the plurality of cooling water feeding passages are disposed around a plurality of transmission gears disposed on the input shaft of the transmission.

The input shaft of the transmission can be driven to continue forward rotation during forward or reverse propulsion, or stop of a hull. The water pump is disposed on the input shaft of the transmission. The water pump can be driven by the input shaft for continuous forward rotation during the forward or reverse propulsion or stop of the hull. Thus, the water pump can feed a cooling water to the engine during the forward or reverse propulsion or stop of the hull.

Since the water pump is disposed on the input shaft of the transmission, rotation of the input shaft can be used to drive the water pump. For this reason, there is no need for an additional member for attachment of the water pump or additional driving means for driving the water pump. As a result, increase in the number of components can be curbed.

Furthermore, the engine is disposed on an upper end portion of the input shaft of the transmission. The water pump is disposed on a lower end portion of the input shaft and the plurality of cooling water feeding passages is disposed along the input shaft. The plurality of cooling water feeding passages can be disposed around the plurality of transmission gears disposed on the input shaft. The plurality of transmission gears tends to generate heat. In view of this, the plurality of cooling water feeding passages is disposed around the plurality of transmission gears. As a result, it becomes possible to efficiently cool the transmission by a cooling water flowing through the plurality of cooling water feeding passages.

Preferably, the outboard engine unit further comprises a cooling water discharging passage communicating with a cooling water outlet of the engine for discharging from the engine a cooling water having cooled the engine. The cooling water discharging passage is disposed above the transmission and rearwardly of the output shaft of the transmission. The output shaft of the transmission extends downwardly, and hence a degree of freedom to design can increase because a space for disposition of the cooling water discharging passages is available above the output shaft. The cooling water discharging passages are disposed above the transmission (the output shaft), such that a cooling water discharged out of the cooling water discharging passages can be guided along an upper portion of the transmission. Thus, the transmission can be efficiently cooled by the cooling water guided along the upper portion of the transmission.

Preferably, the outboard engine unit further comprises a lubricating oil passageway for directing a lubricating oil to lubricate the transmission. The transmission comprises a case including a sidewall facing the cooling water discharging passage, and an upper portion opposed to the cooling water discharging passage, and the lubricating oil passageway is disposed along the sidewall and the upper portion. For this reason, a cooling water discharged out of the cooling water discharging passages can be guided along the case oil passageway, thereby cooling a lubricating oil introduced into the case oil passageway with the result that the transmission can be efficiently cooled.

According to another aspect of the present invention, there is provided an outboard engine unit including an engine, a propeller shaft, and a transmission interposed between the engine and the propeller shaft, the transmission including a case disposed below the engine, the outboard engine unit comprising: a discharge port disposed above the case for discharging a cooling water having cooled the engine; and a cooling water storing portion disposed on an upper portion of the case in opposed relationship to the discharge port for storing the cooling water.

The upper portion of the transmission can be cooled by the engine-cooling water, and thus the transmission can be cooled. The use of the engine-cooling water is a simple form to cool the transmission.

Preferably, the outboard engine unit further comprises: an exhaust port disposed above the case for discharging an exhaust gas from the engine; and a shielding plate disposed on a top part of the cooling water storing portion for preventing the exhaust gas from blowing against the upper portion of the case. Since the shielding plate is disposed on the top part of the cooling water storing portion, the shielding plate prevents exhaust gas from blowing against the upper portion of the case. As a result, it becomes possible to prevent the upper portion of the case from being heated by the exhaust gas and hence the transmission case can be well cooled. Since the shielding plate is positioned on the top part of the cooling water storing portion, a cooling water stored in the cooling water storing portion can be protected from the exhaust gas.

Preferably, the outboard engine unit further comprises a lubricating oil passageway formed in the upper portion of the case for directing a lubricating oil to lubricate the transmission. Thus, the lubricating oil can be well cooled by the engine-cooling water stored in the cooling water storing portion.

BRIEF DESCRIPTION OF THE DRAWINGS

A preferred embodiment of the present invention will be described in detail below, by way of example only, with reference to the accompanying drawings, in which.

DETAILED DESCRIPTION OF THE PREFERRED EMBODIMENT

Figure 1:
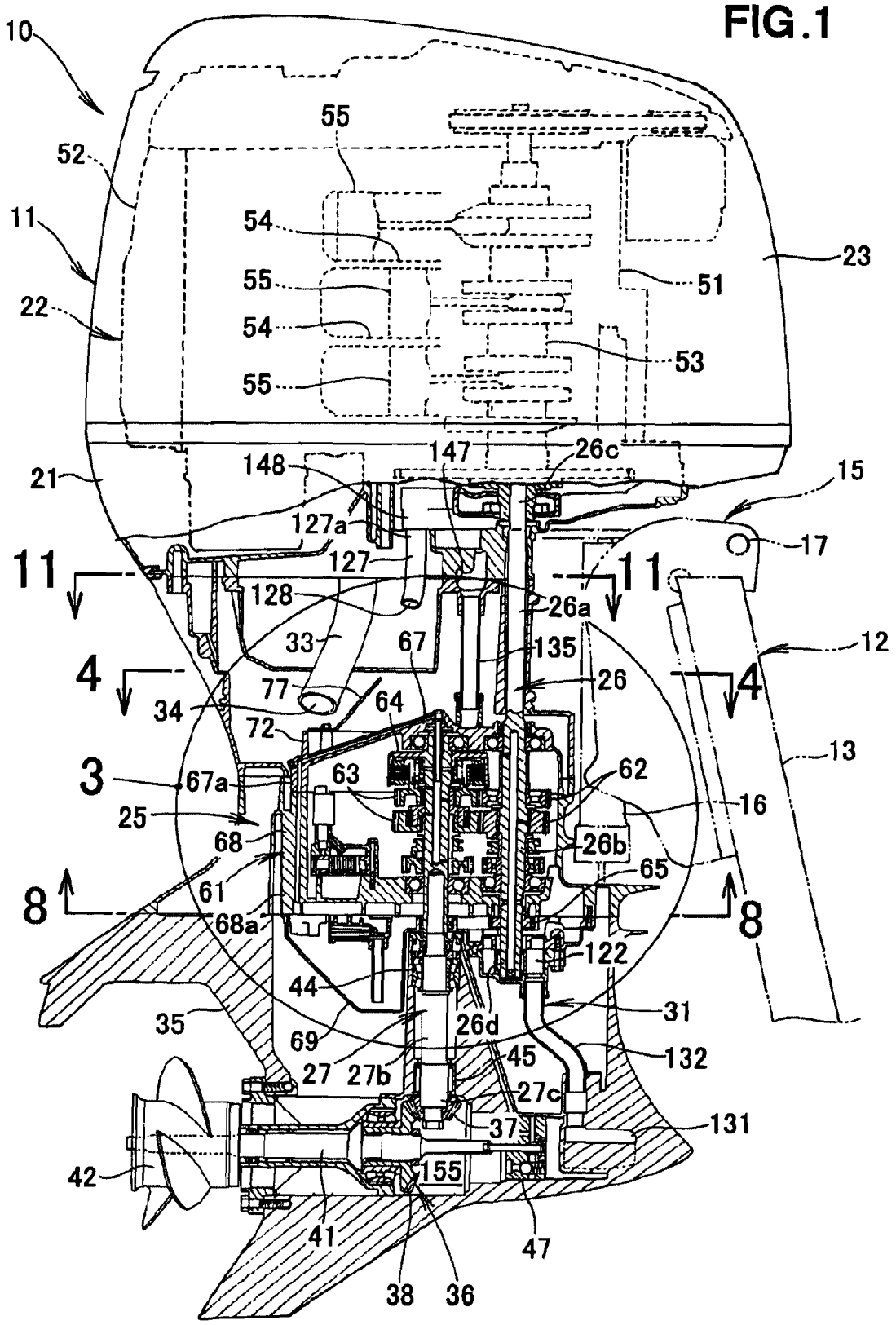
FIG. 1 is a cross-sectional view of an outboard engine unit in a preferred embodiment of the present invention.

Referring to FIG. 1, an outboard engine unit 10 includes an outboard engine unit body 11 and attachment means 15 disposed on the outboard engine unit body 10 and detachably attached to a hull 12 (more specifically, a stern 13). The attachment means 15 includes a swivel shaft 16 on which the outboard engine unit body 11 pivots in a right-and-left direction (a horizontal direction), and a tilt shaft 17 on which the outboard engine unit body 11 pivots in an up-and-down direction.

The outboard engine unit body 11 includes a mount case (an upper case) 21 disposed on the attachment means 15, an engine 22 carried on an upper portion of the mount case 21, an engine cover 23 covering the engine 22, a transmission 25 disposed within a lower portion of the mount case 21, cooling means 31 for cooling the transmission 25 and the engine 22, and a pair of exhaust pipes 33 for discharging an exhaust gas (combustion gas) of the engine 22.

The outboard engine unit body 11 further includes a lower case 35 receiving a lower portion of the transmission 25, a bevel gear mechanism 36 disposed within the lower case 35, a propeller 42 to be rotated by rotation of the bevel gear mechanism 36 through a propeller shaft (propeller drive shaft) 41, and first lubrication means 47 for lubricating a tapered roller bearing (a support member) 44 disposed on an output shaft 27 of the transmission 25. The bevel gear mechanism 36 is connected to the output shaft 27 of the transmission 25.

In short, the transmission 25 is disposed below the engine 22, and the bevel gear mechanism 36 and the propeller shaft 41 are disposed below the transmission 25. That is, the transmission 25 is interposed between the engine 22 and the propeller shaft 41. The transmission 25 has an input shaft 26 connected to the engine 22, and the output shaft 27 connected via the bevel gear mechanism 36 to the propeller shaft 41.

The engine 22 includes a cylinder block 51, a head cover 52, a crankshaft 53, cylinders 54, and pistons 55. The crankshaft 53 of the engine 22 is connected to the input shaft 26 of the transmission 25. When the engine 22 is driven to rotate the crankshaft 25, the rotation of the crankshaft 25 is transmitted to the input shaft 26 of the transmission 25.

The transmission 25 includes a transmission case 61 interposed between the mount case 21 and the lower case 35, the input and output shafts 26, 27 rotatably supported by the transmission case 61, a plurality of transmission gears 62 disposed on the input shaft 26, a plurality of transmission gears 63 disposed on the output shaft 27, a clutch 64 disposed on the output shaft 27 for allowing the hull to travel in second gear, and second lubrication means 65 for lubricating various lubrication parts within the transmission case 61.

The transmission case 61 is disposed below the engine 22. The transmission case 61 includes an upper transmission case 67 accommodated in the mount case 21, a lower transmission case 68 disposed on a lower portion 67*a* of the upper transmission case 67, and an oil case (an oil pan) 69 disposed on a lower portion 68*a* of the lower transmission case 68.

Figure 2:
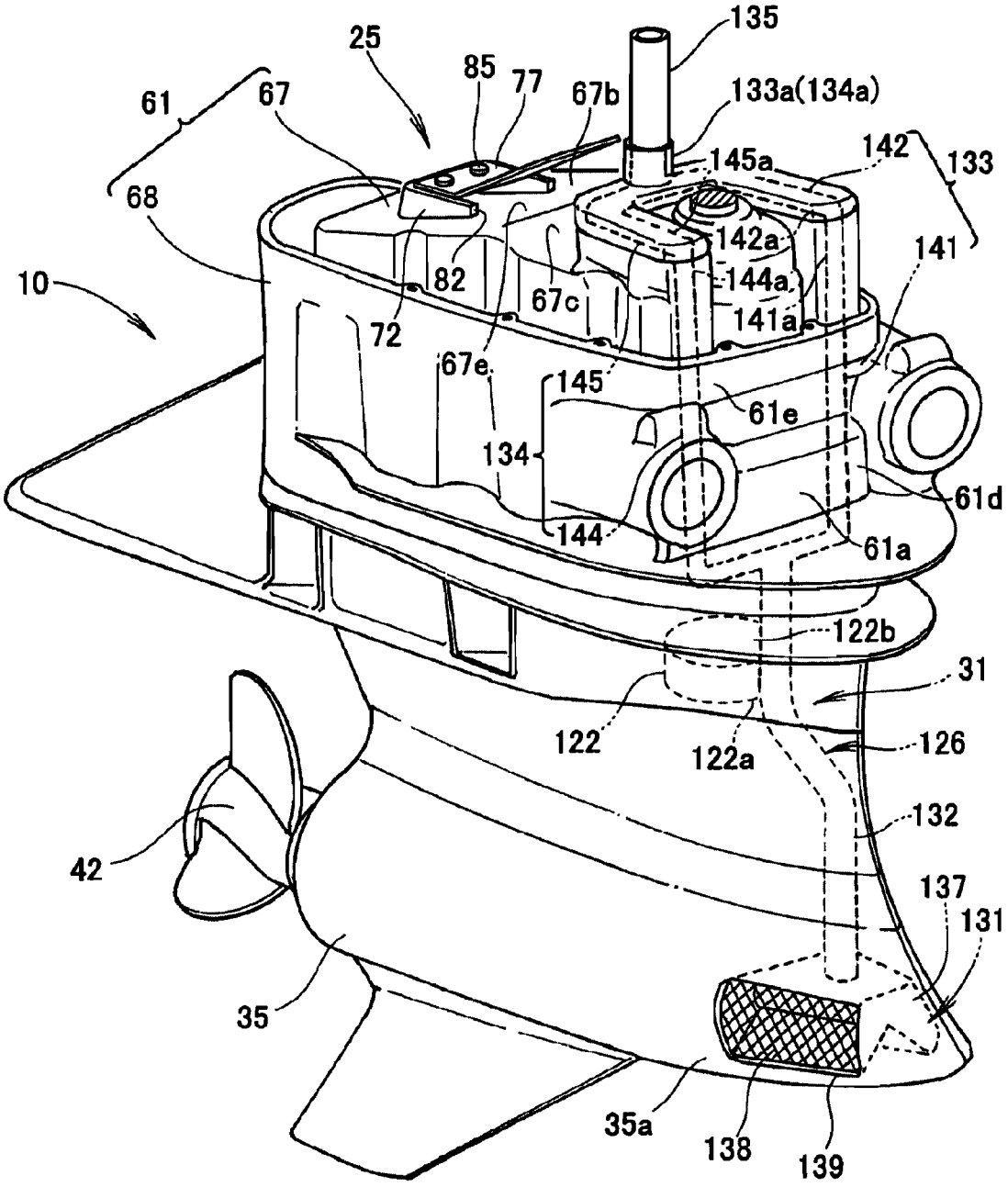
FIG. 2 is a front perspective view of a transmission and cooling means shown in FIG. 1.
Figure 3:
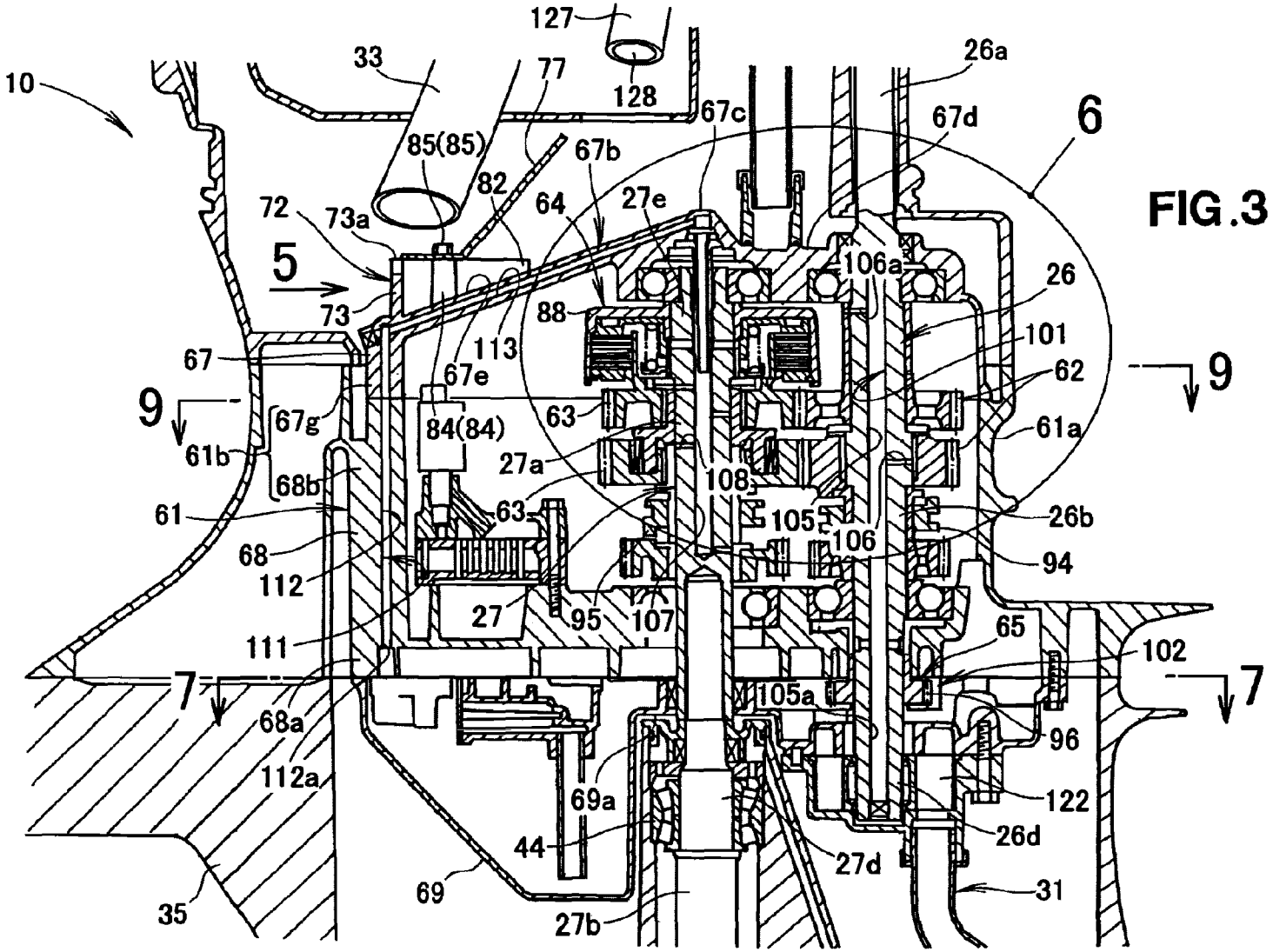
FIG. 3 is an enlarged view of a region 3 of FIG. 1.

As shown in FIG. 2 and FIG. 3, the upper transmission case 67 includes an upper flat portion 67*d* extending substantially horizontally forwardly from a center 67*c* of an upper portion 67*b* of the upper transmission case 67. The upper transmission case 67 also includes an upper slanting portion 67*e* extending obliquely downwardly and rearwardly from the center 67*c*. On the upper slanting portion 67*e*, a cooling water storing portion 72 and a shielding plate 77 are disposed.

Figure 4:
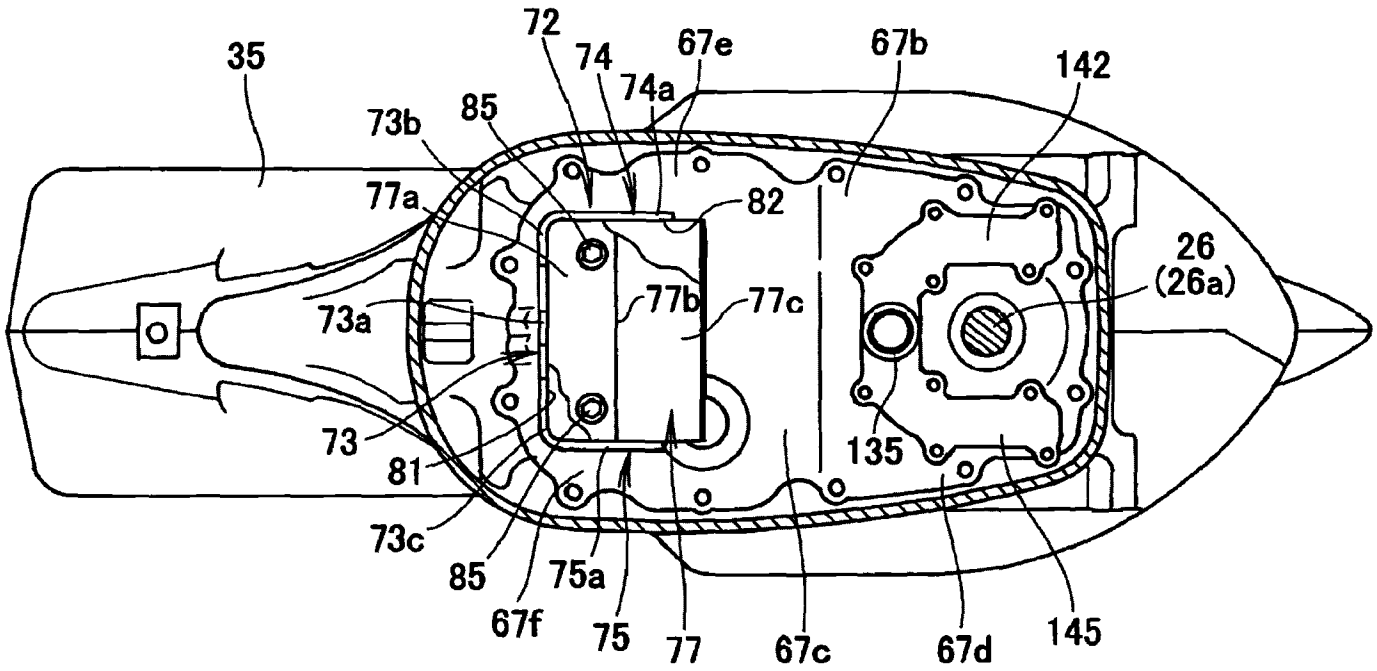
FIG. 4 is a cross-sectional view taken along line 4-4 of FIG. 1.
Figure 5:
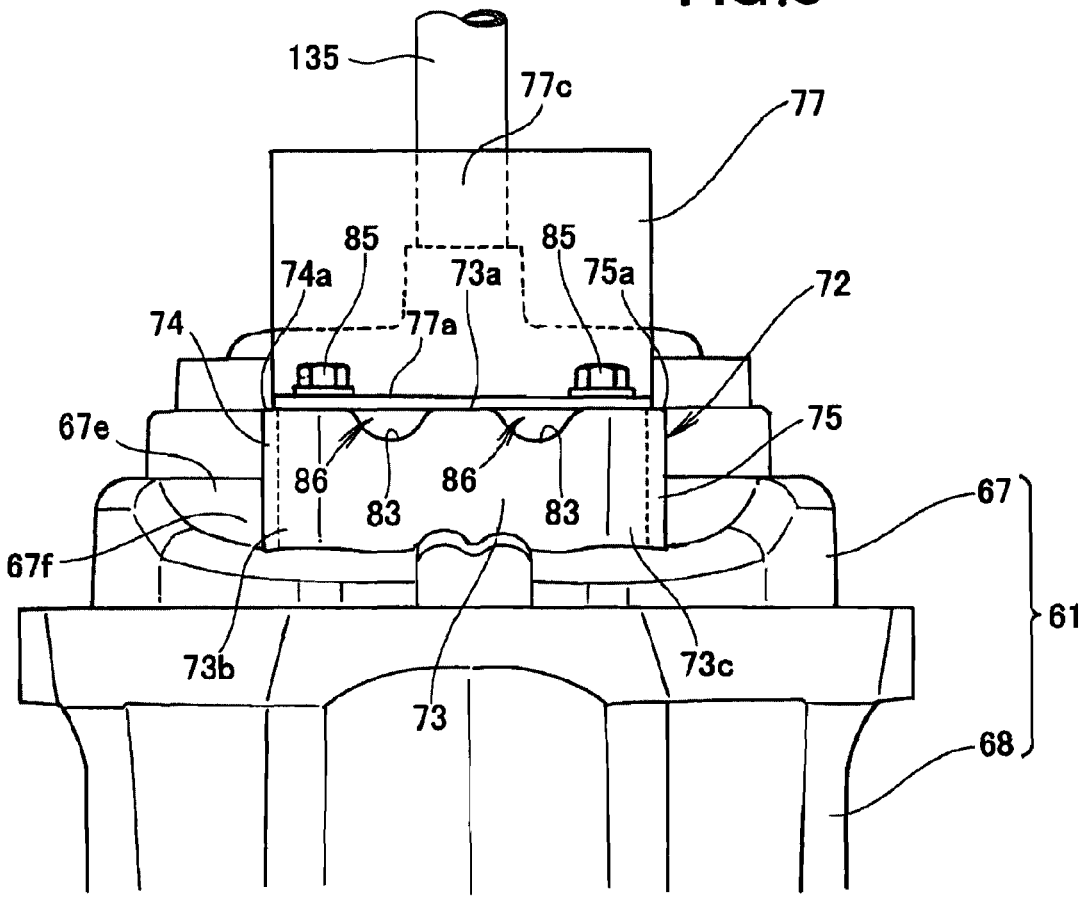
FIG. 5 is a view taken in a direction of an arrow 5 of FIG. 3.

As shown in FIG. 4 and FIG. 5, the cooling water storing portion 72 includes a rear wall 73 disposed on a rear part 67*f* of the upper slanting portion 67*e* and extending laterally thereof, a left sidewall 74 extending forwardly from a left end 73*b* of the rear wall 73, and a right sidewall 75 extending forwardly from a right end 73*c* of the rear wall 73. The rear wall 73, the left sidewall 74, and the right sidewall 75 have their upper surfaces 73*a*, 74*a*, 75*a*, respectively, which extend substantially horizontally.

The cooling water storing portion 72 has a substantially U-shape defined by the rear wall 73 and the left and right sidewalls 74, 75 when the cooling water storing portion 72 is viewed in top plan. The cooling water storing portion 72 has a top part defining an opening 81, and a front part defining an introduction port 82. The upper slanting portion 67*e* provides a downward slope from the introduction port 82 to the rear wall 73. The upper surface 73*a* of the rear wall 73 has a pair of recesses 83 formed thereon.

The shielding plate 77 is attached to the upper slanting portion 67*e* (more specifically, a pair of bosses 84 (FIG. 3)) by means of a pair of bolts 85, such that the shielding plate 77 is placed on the top part of the cooling water storing portion 72 (i.e., on the upper surfaces 73*a*, 74*a*, 75*a* of the rear wall 73, the left sidewall 74 and the right sidewall 75). The pair of bolts 85 is screwed into the pair of bosses 84 formed on the upper slanting portion 67*e*. The shielding plate 77 has a substantially rectangular shape when viewed in top plan, and includes a horizontal attachment portion 77*a* attached to the pair of bosses 84 by the pair of bolts 85, and an inclining portion 77*c* extending obliquely upwardly and forwardly from a front side 77*b* of the horizontal attachment portion 77*a*.

Since the horizontal attachment portion 77*a* is attached to the pair of bosses 84 by the pair of bolts 85, the opening 81 (i.e., the top part) of the cooling water storing portion 72 is covered by the shielding plate 77. Since the horizontal attachment portion 77*a* is attached to the pair of bosses 84 by the pair of bolts 85, furthermore, the horizontal attachment portion 77*a* and the pair of recesses 83 of the rear wall 73 jointly define discharge openings 86. A reason why the upper slanting portion 67*e* slants downwardly and the cooling water storing portion 72 and the shielding plate 77 are disposed on the upper slanting portion 67*e* will be detailed later.

As shown in FIG. 1 and FIG. 3, the input shaft 26 connected to the crankshaft 53 of the engine 22 is disposed inside the transmission case 61 in vertical orientation closely to a front wall 61*a* of the transmission case 61. The input shaft 26 includes a lower half 26*b* accommodated in the transmission case 61, and an upper half 26*a* protruding out of the upper flat portion 67*d* of the upper transmission case 67 toward the engine 22. The upper half 26*a* has an upper end portion 26*c* connected to the crankshaft 53 of the engine 22. The output shaft 27 is spaced rearwardly from the input shaft 26 by a predetermined interval.

The output shaft 27 is disposed substantially centrally of the transmission case 61 in vertical orientation. The output shaft 27 is connected to the input shaft 26 via the transmission gears 62, 63 disposed on the input and output shafts 26, 27, respectively. The output shaft 27 includes an upper half 27*a* accommodated in the transmission case 61, and a lower half 27*b* protruding from a bottom portion 69*a* of the oil case 69 toward the bevel gear mechanism 36. The lower half 27*b* has a lower end portion 27*c* carrying a pinion (a pinion bevel gear) 37 of the bevel gear mechanism 36, which pinion is coaxial with the lower end portion 27*c*.

The lower half 27*b* of the output shaft 27 has an upper portion 27*d* rotatably supported by the tapered roller bearing 44, and a vicinity of the lower end portion 27*c* of the lower half 27*b* is rotatably supported by a roller bearing 45. The plurality of transmission gears 62 is disposed on the lower half 26*b* of the input shaft 26, and the plurality of transmission gears 63 is disposed on the upper half 27*a* of the output shaft 27. The upper half 27*a* of the output shaft 27 has an upper end portion 27*e* carrying the clutch 64 thereon.

Figure 6:
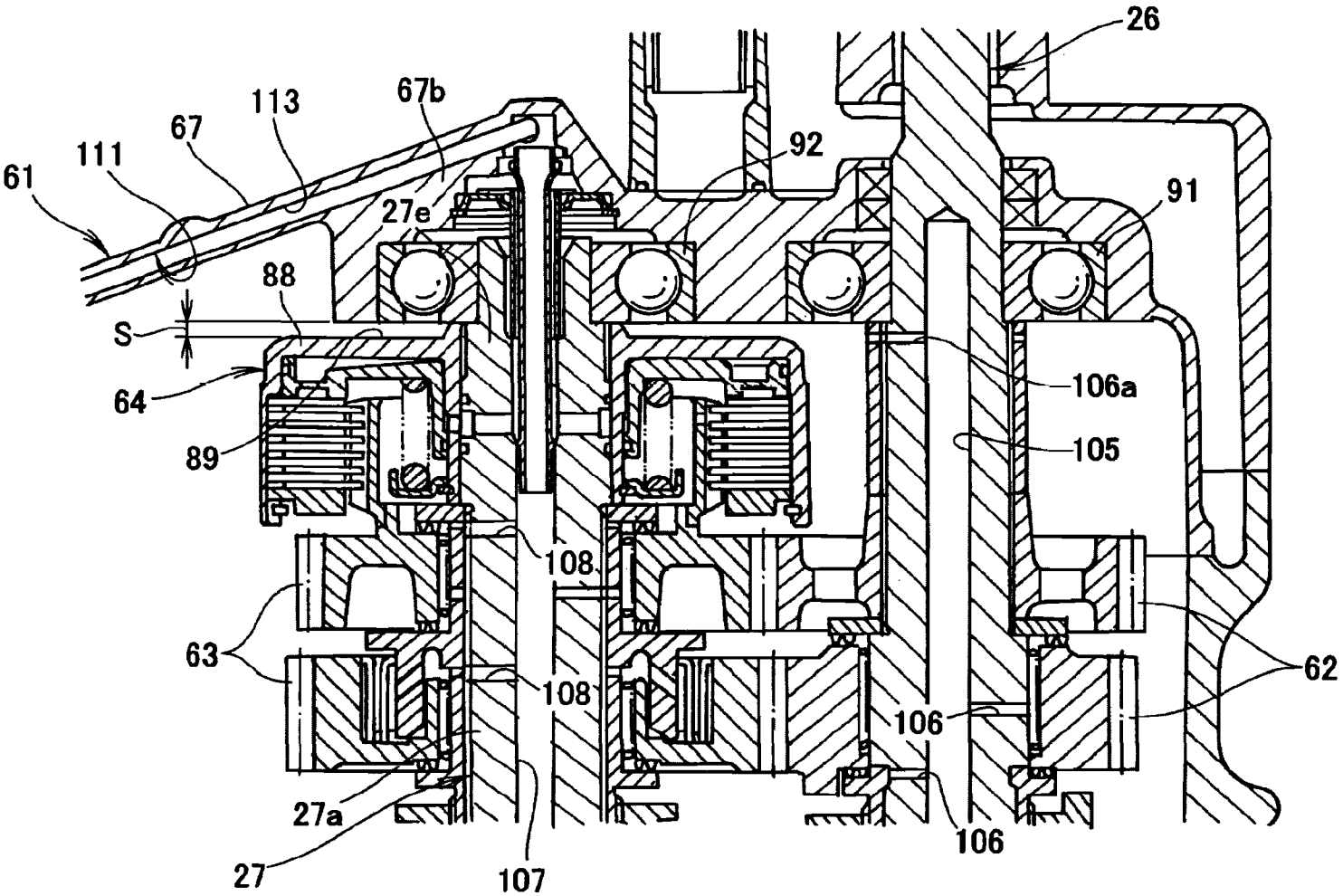
FIG. 6 is an enlarged view of a region 6 of FIG. 3.

As shown in FIG. 6, the clutch 64 is a wet clutch having a clutch housing 88 disposed at an upper portion thereof. The clutch housing 88 is disposed on the upper end portion 27*e* of the upper half 27*a*. The clutch housing 88 rotates together with the output shaft 27 as the output shaft 27 rotates.

The clutch housing 88 is spaced a predetermined interval S from the upper portion 67*b* of the transmission case 61 (the upper transmission case 67) to define a lubrication space 89 (a space) therebetween. The lubrication space 89 is sized such that, when a lubricating oil jets into the space 89 between the clutch housing 88 and the upper portion 67*b*, the lubricating oil produces a surface tension.

An input shaft bearing 91 and output shaft bearing 92 are disposed in the upper portion 67*b* of the upper transmission case 67. The input shaft 26 is rotatably supported by the input shaft bearing 91 and the output shaft 27 is rotatably supported by the output shaft bearing 92. The input shaft bearing 91 and the output shaft bearing 92 are located at the same level as a lower end of the upper portion 67*b* of the upper transmission case 67.

As shown in FIG. 1 and FIG. 3, a positive clutch 94 is disposed on the lower half 26*b* of the input shaft 26 for propelling the hull forwardly, and a positive clutch 95 is disposed on the upper half 27*a* of the output shaft 27 for propelling the hull backwardly. Manipulation of the positive clutch 94 provided for forward propulsion of the hull allows forward rotation of the output shaft 27. The forward rotation of the output shaft 27 causes forward rotation of the propeller shaft 41 (i.e., the propeller 42) to thereby make the hull travel in first gear.

The clutch 64 can be switched to an "engaged" state to allow the hull to travel forwardly in second gear. That is, the clutch 64 is provided for switching the hull into the forward travelling in the second gear. Manipulation of the positive clutch 95 provided for the reverse propulsion of the hull allows reverse rotation of the output shaft 27. The reverse rotation of the output shaft 27 causes reverse rotation of the propeller shaft 41 (i.e., the propeller 42) to thereby make the hull travel backwardly.

The second lubrication means 65 includes a second oil pump 96 (an oil pump for the transmission 65) for pumping up a lubricating oil stored in the oil case 69, and lubricating oil passages generally designated at 101 for circulating the lubricating oil, pumped up by the second oil pump 96, within the transmission case 61.

Figure 7:
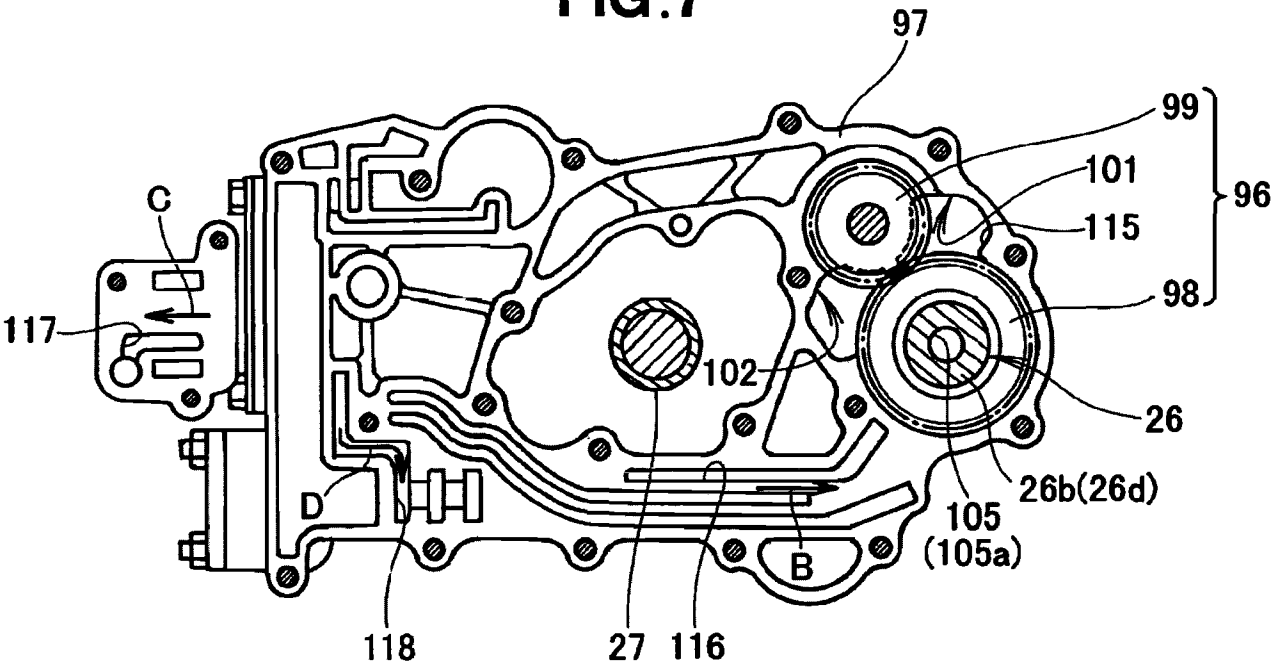
FIG. 7 is a cross-sectional view taken along line 7-7 of FIG. 3.

As shown in FIG. 7, the second oil pump 96 is disposed in an oil pump case 97. The oil pump case 97 is accommodated in the oil case 69 (FIG. 3). The second oil pump 96 is a gear pump including a drive gear 98 disposed on a vicinity of an upper side of a lower end portion 26*d* of the lower half 26*b* of the input shaft 26, and a driven gear 99 meshing with the drive gear 98.

Figure 8:
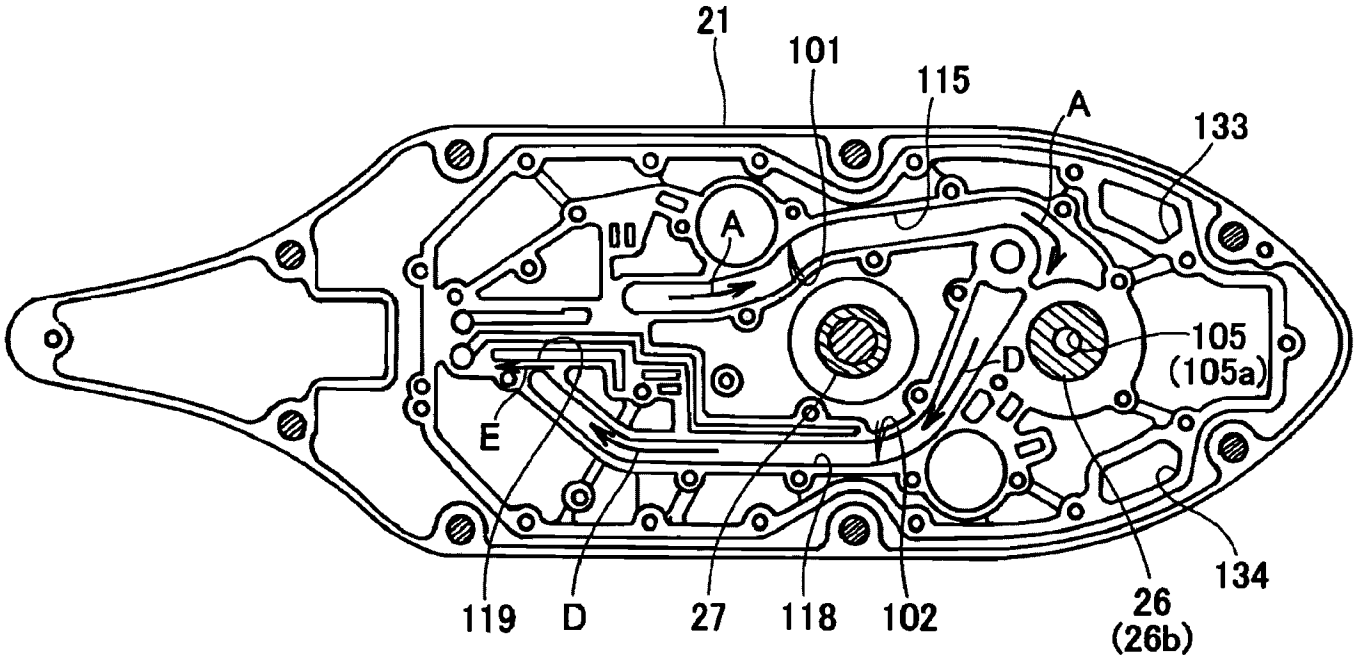
FIG. 8 is a cross-sectional view taken along line 8-8 of FIG. 1.

As shown in FIG. 7 and FIG. 8, the lubricating oil passages 101 include oil feeding passages generally designated at 102

(see also FIG. 3) for directing a lubricating oil stored in the oil case 69 to the respective lubrication parts, and oil returning passages 103 (see FIG. 9) for returning lubricating oils having lubricated the lubrication parts, to the oil case 69.

As shown in FIG. 3, the oil feeding passages 102 include an input shaft oil passageway (a lubricating oil passageway) 105 coaxial with and formed in the input shaft 26, and a plurality of input shaft jet ports (lubricating oil jet ports) 106 (see also FIG. 6) communicating with the input shaft oil passageway 105, an output shaft oil passageway (a lubricating oil passageway) 107 coaxial with and formed in the output shaft 27, and a plurality of output shaft jet ports (lubricating oil jet ports) 108 (see also FIG. 6) communicating with the output shaft oil passageway 107. The oil passageways 105, 107 are oil passageways for directing lubricating oils.

As shown in FIG. 6, the plurality of input shaft jet ports 106 are oriented in a (horizontal) direction perpendicular to the input shaft oil passageway 105. From the plurality of input shaft jet ports 106, lubricating oils directed into the oil passageway 105 jet into a space defined within the transmission case 61. The uppermost one 106*a* of the plurality of input shaft jet ports 106 is opposed to the lubrication space 89.

As shown in FIG. 3 and FIG. 6, the clutch housing 88 of the clutch 64, which is disposed on the output shaft 27, rotates together with the output shaft 27. The clutch housing 88 is disposed closely to the upper portion 67*b* of (the upper transmission case 67) of the transmission case 61 with the lubrication space 89 being formed between the clutch housing 88 and the upper portion 67*b*. The uppermost jet port 106*a* is disposed in opposed relationship to the lubrication space 89. Thus, the uppermost jet port 106*a* can spout a lubricating oil into the lubrication space 89 between the clutch housing 88 and the transmission case 61. A reason to spout the lubricating oil from the uppermost jet pot 106*a* into the lubrication space 89 will be detailed with reference to FIG. 12.

The uppermost jet port 106*a* opens into a space below the input shaft bearing 91 and is located at a lower level than the output shaft bearing 92. Since the uppermost jet port 106*a* opens into the space below the input shaft bearing 91, the uppermost jet port 106*a* can spout a lubricating oil to the input shaft bearing 91.

The plurality of output shaft jet ports 108 are oriented in a (horizontal) direction perpendicular to the output shaft oil passageway 107, as are the plurality of input shaft jet ports. From the plurality of output shaft jet ports 108, lubricating oils directed into the output shaft oil passageway 107 jet into a space within the transmission case 61.

As shown in FIG. 3, the oil feeding passages 102 include a case oil passageway (a lubricating oil passageway) 111 formed in the transmission case 61. The case oil passageway 111 includes a rear oil passageway 112 formed in a rear wall 61*b* of the transmission case 61 (more specifically, a rear wall 68*b* of the lower transmission case 68 and a rear wall 67*g* of the upper transmission case 67), and an upper oil passageway (a lubricating oil passageway) 113 formed in the upper slanting portion 67*e* (the upper portion 67*b*) of the upper transmission case 67. The case oil passageway 111 extends to a location above the output shaft 27 and communicates with the output shaft oil passageway 107.

In addition, as shown in FIG. 7 and FIG. 8, the oil feeding passages 102 include an oil drawing passageway 115, a first case oil passageway 116, a second case oil passageway 117, a third case oil passageway 118 and a fourth case oil passageway 119.

The oil drawing passageway 115 is a passageway for directing a lubricating oil stored in the oil case 69 (FIG. 3) to the second oil pump 96, as indicated by an arrow A. The first case oil passageway 116 is a passageway for directing the lubricating oil from the second oil pump 96 to a lower end portion 105*a* (FIG. 3) of the input shaft oil passageway 105, as indicated by an arrow B. The second case oil passageway 117 is a passageway for directing the lubricating oil from the second oil pump 96 to a lower end portion 112*a* (FIG. 3) of (the rear oil passageway 112 of) the case oil passageway 111, as indicated by an arrow C.

The third case oil passageway 118 is a passageway for directing a lubricating oil pumped out from the second oil pump 96, to a regulator valve etc., as indicated by an arrow D. The fourth case oil passageway 119 is a passageway for directing a lubricating oil pumped out from the second oil pump 96, to a relief valve, as indicated by an arrow E. The regulator valve and the relief valve are valves disposed in a circuit controlling the transmission 25 for maintaining a preferable hydraulic pressure in the circuit.

Figure 9:
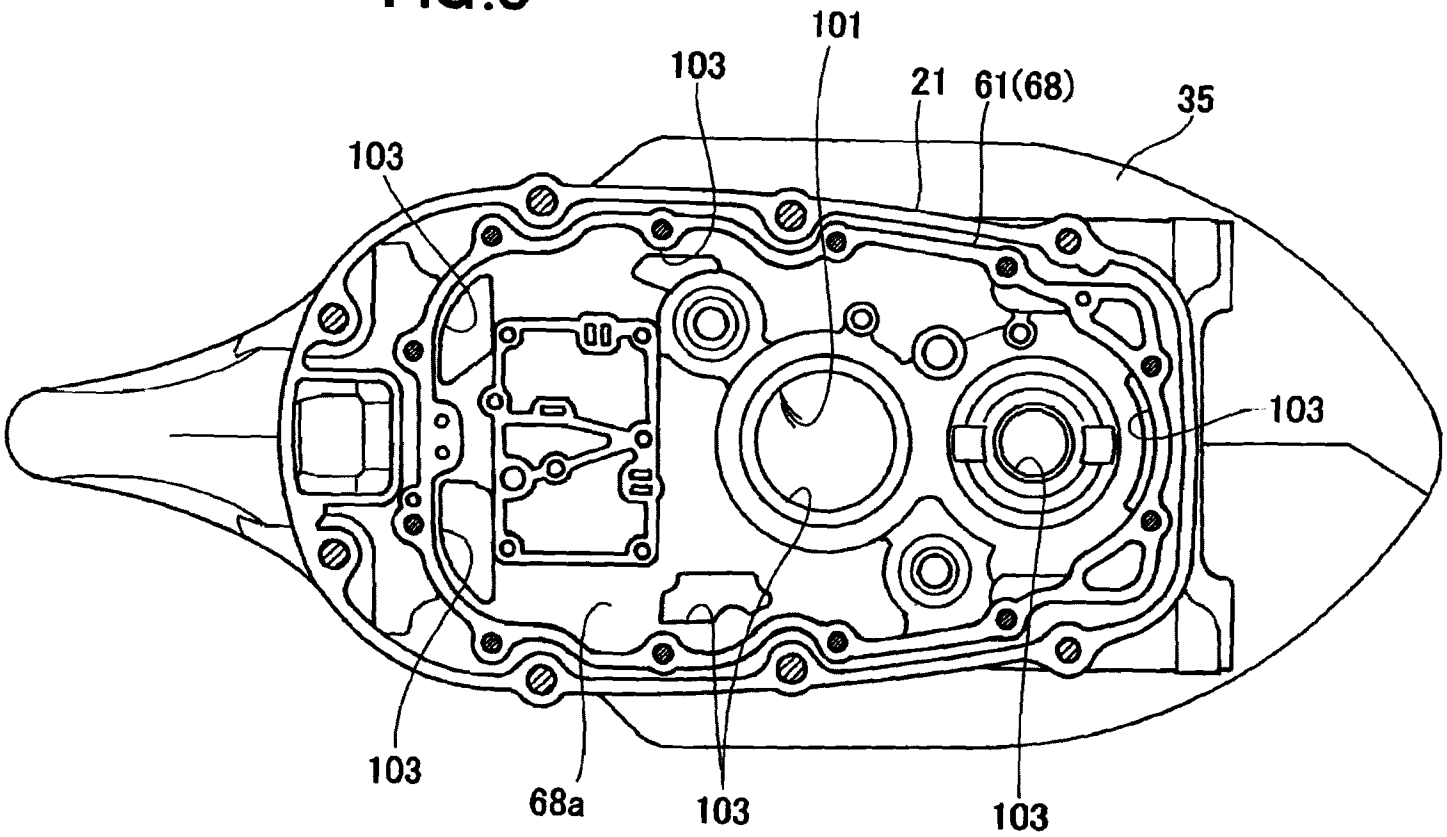
FIG. 9 is a cross-sectional view taken along line 9-9 of FIG. 3.

As shown in FIG. 3 and FIG. 9, the plurality of oil returning passages 103 are formed inside the transmission case 61 and communicate with the oil case 69. The oil case 69 is disposed on the lower portion 68*a* of (the lower transmission case 68 of) the transmission case 61. By the plurality of oil returning passages 103, a lubricating oil having lubricated the various lubrication parts of the plurality of transmission gears 62, 63 and the clutch 64 etc. can be returned to the oil case 69. Since the plurality of oil returning passages 103 are formed throughout the inside of the transmission case 61, lubricating oils distributed to the inside of the transmission case 61 can be efficiently returned to the oil case 69.

Figure 10:
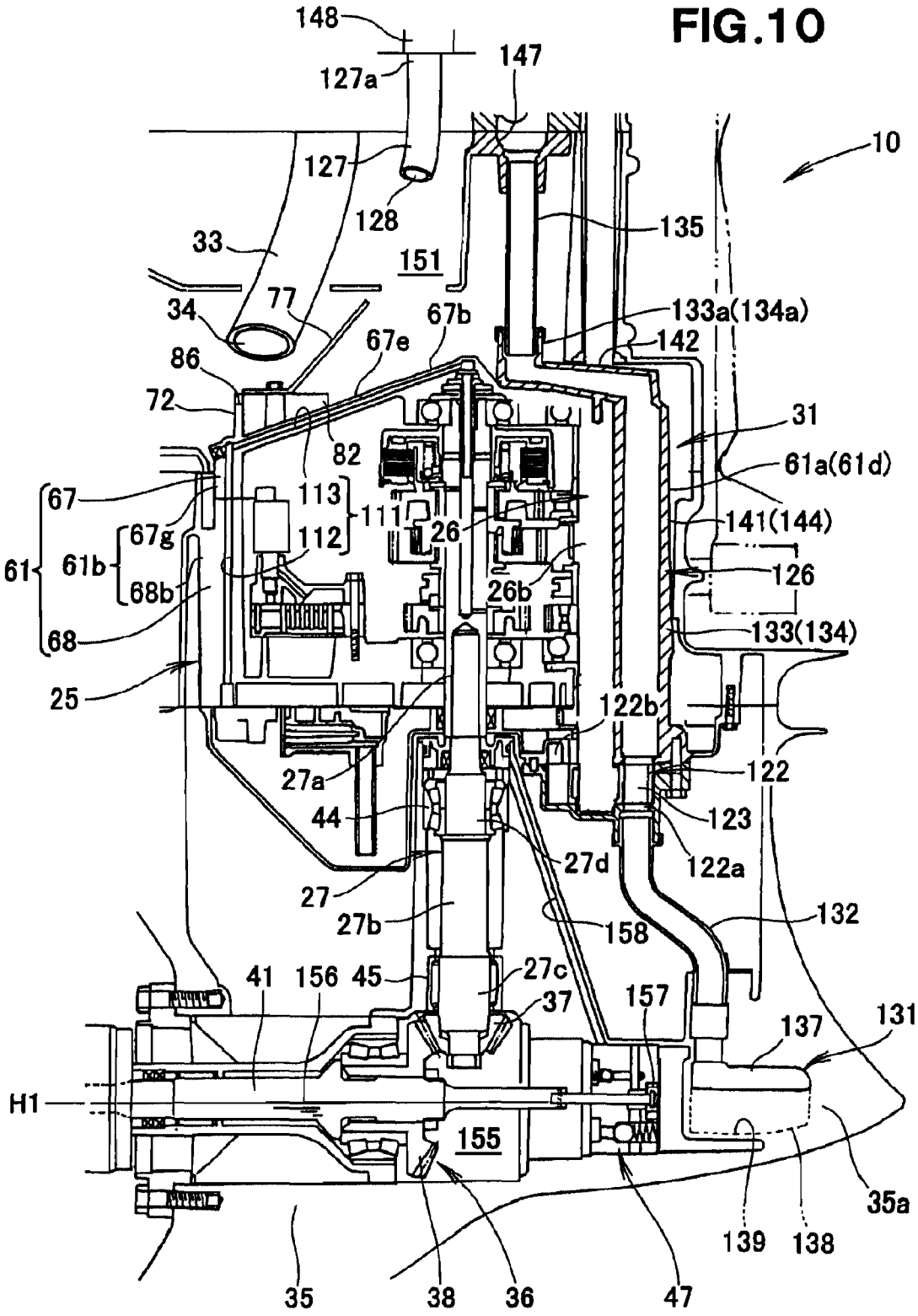
FIG. 10 is a cross-sectional view of the cooling means shown in FIG. 1.

As shown in FIG. 1 and FIG. 10, the cooling means 31 includes a water pump 122 disposed on the lower end portion 26*d* (FIG. 3) of the lower half 26*b*, a cooling water feeding system 126 for directing a cooling water drawn by the water pump 122, to the engine 22 (FIG. 1), and a pair of cooling water discharging passages 127, 127 for discharging the cooling water having cooled the engine 22.

The water pump 122 is a gear pump including a drive gear 123 disposed on the lower end portion 26*d* of the lower half 26*b*, and a driven gear (not shown) meshing with the drive gear 123. The water pump 122 is disposed partway on the cooling water feeding system 126. The cooling water feeding system 126 includes a drawing portion 131 for drawing a cooling water from an outside 14 of the outboard engine unit 10, and a drawing passage 132 communicating with both the drawing portion 131 and an inlet 122*a* of the water pump 122, left and right feeding passages (a plurality of cooling water feeding passages) 133, 134 (FIG. 8) communicating with an outlet 122*b* of the water pump 122, and a guide passage 135 communicating with upper end portions 133*a*, 134*a* of the left and right feeding passages 133, 134.

As shown in FIG. 2 and FIG. 10, the drawing portion 131 includes a substantially inverted-Y-shaped drawing passageway 137, and left and right water screens 138 disposed at lower end portions of left and right sides of the drawing passageway 137. The left and right water screens 138 are disposed in left and right inlet ports 139 of the lower case 35. The left and right inlet ports 139 define left and right openings of a lower front portion 35*a* of the lower case 35. The drawing passageway 137 communicates with the inlet 122*a* of the water pump 122 through the drawing passage 132.

The left feeding passage 133 includes a left vertical flow passage 141 formed in a left side portion 61*d* of the front wall 61*a* of the transmission case 61, and a left horizontal flow passage 142 having a front end portion 142*a* communicating with an upper end portion 141*a* of the left vertical flow passage 141. The right feeding passage 134 is in symmetric relationship to the left feeding passage 133. The right feeding passage 134 includes a right vertical flow passage 144 formed in a right side portion 61*e* of the front wall 61*a* of the transmission case 61, and a right horizontal flow passage 145 having a front end portion 145*a* communicating with an upper end portion 144*a* of the right vertical flow passage 144.

The left horizontal flow passage 142 and the right horizontal flow passage 145 have their respective rear end portions (i.e., the upper end portions 133*a*, 134*a* of the left and right feeding passages 133, 134) meeting each other. The upper end portions 133*a*, 134*a* meeting each other communicate with a water jacket inlet (cooling water inlet) 147 of the engine 22 (FIG. 1) through the guide passage 135. A water jacket of the engine 22 is a cooling water passage used to cool a typical engine.

The left and right vertical flow passages 141, 144 are disposed alongside the lower half 26*b* and located rightwardly and leftwardly of the lower half 26*b* (FIG. 8). As a result, the left and right vertical flow passages 141, 144 are disposed around the plurality of transmission gears 62 (FIG. 3) disposed on the lower half 26*b*. The left and right vertical flow passages 141, 144 can be used as cooling means for the transmission 25.

In the cooling means 31, a cooling water is introduced or drawn from the outside 14 of the outboard engine unit 10 though the left and right inlet ports 139 into the drawing passage 137 by driving the water pump 122. The cooling water introduced into the drawing passage 137 by the water pump 137 is directed through the left and right feeding passages 133, 134 and the guide passage 135 into the water jacket inlet 147 of the engine 22.

The water pump 122 has the drive gear 123 disposed on the input shaft 26 of the transmission 25 (FIG. 3). The water pump 122 can be driven by the input shaft 26 for continuous forward rotation during forward or reverse propulsion or stop of the hull 12. Thus, the water pump 122 can feed water to the engine 22 during the forward or reverse propulsion or stop of the hull 12.

Since the water pump 122 is disposed on the input shaft 26 of the transmission 25, rotation of the input shaft 26 can be used to drive the water pump 122. For this reason, there is no need for an additional member for attachment of the water pump 122 or additional driving means for driving the water pump 122. As a result, increase in the number of components can be curbed.

The plurality of transmission gears 62 disposed on the lower half 26*b* tends to generate heat by meshing with the plurality of transmission gears 63. In view of this, the left and right vertical flow passages 141, 144 are disposed around the plurality of transmission gears 62. As a result, it becomes possible to efficiently cool the plurality of transmission gears 62 (i.e., the transmission 25) by a cooling water flowing through the left and right vertical flow passages 141, 144.

Figure 11:
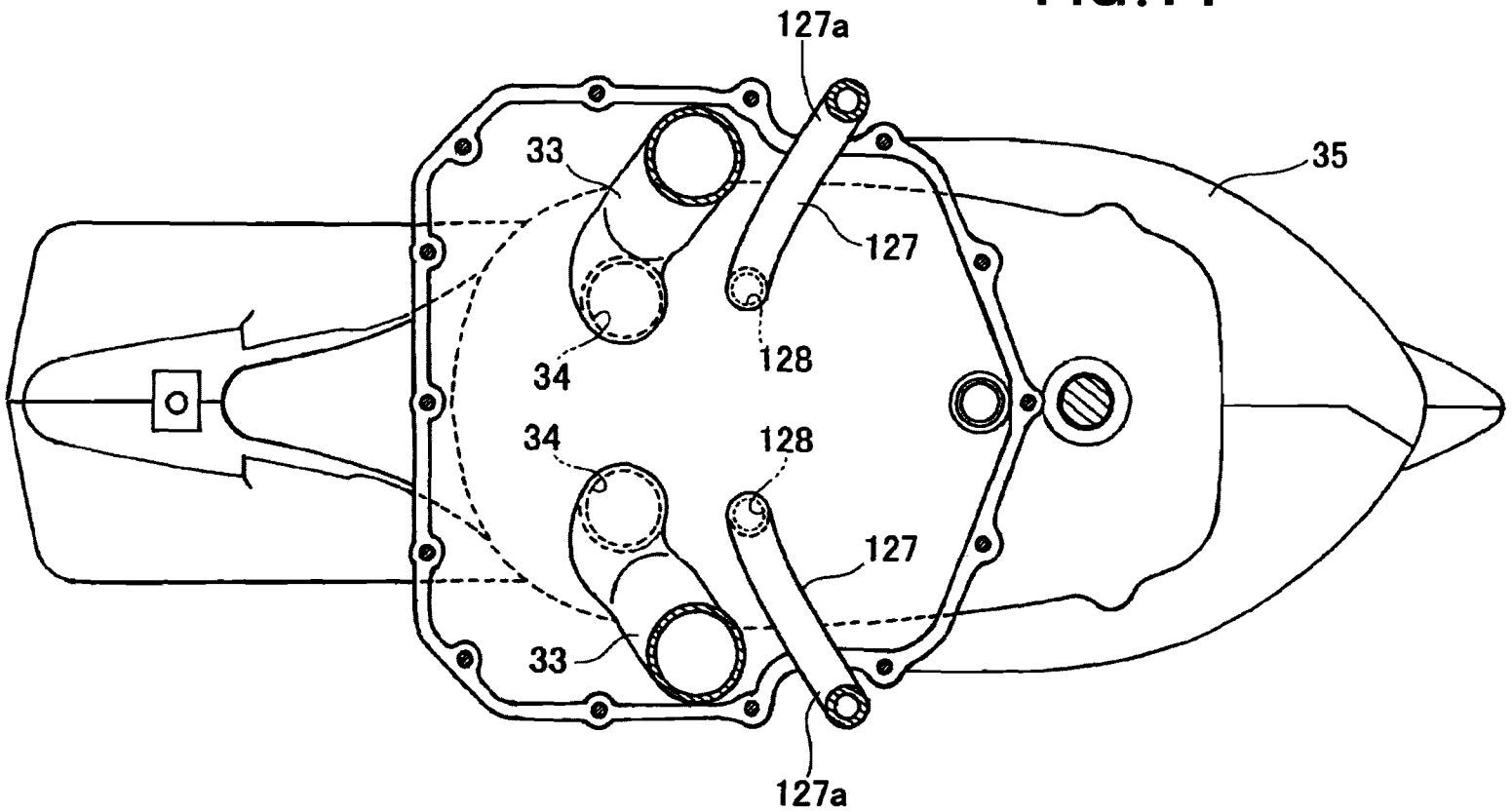
FIG. 11 is a cross-sectional view taken along line 11-11 of FIG. 1.

The pair of cooling water discharging passages 127, 127 have upper end portions 127*a*, 127*a* communicating with a water jacket outlet (a cooling water outlet) 148 of the engine 22. As shown in FIG. 10 and FIG. 11, the cooling water discharging passages 127, 127 are disposed above the transmission 25 (more specifically, the upper slanting portion 67*e* of the upper transmission case 67) and the output shaft 27. The cooling water discharging passages 127, 127 have discharge ports 128, 128 formed at lower end portions 128, 128 thereof. The discharge ports 128, 128 of the cooling water discharging passages 127, 127 are disposed above the transmission case 61.

The output shaft 27 of the transmission 25 extends downwardly and the cooling water discharging passages 127, 127 are disposed forwardly of the output shaft 27. For this reason, a degree of freedom to design can increase because a space 151 for disposition of the cooling water discharging passages 127, 127 is available above the output shaft 27.

Since the upper end portions 127*a*, 127*a* of the cooling water discharging passages 127, 127 communicate with the water jacket outlet 148, a cooling water having cooled the engine 22 is discharged out of the cooling water discharging passages 127, 127 via the water jacket outlet 148. In this regard, the cooling water discharging passages 127, 127 are disposed above the transmission 25 (the output shaft 27), such that a cooling water discharged out of the discharge ports 128, 128 of the cooling water discharging passages 127, 127 can be guided along an upper portion of the transmission 25 (more specifically, along the upper slanting portion 67*e* of the upper transmission case 67). Thus, the transmission 25 can be efficiently cooled by the cooling water guided along the upper slanting portion 67*e* of the upper transmission case 67.

The cooling water discharging passages 127, 127 are oriented toward an area of the upper portion 67*b* of the upper transmission case 67, which area is close to the rear wall 61*b* of the transmission case 61 (more specifically, the rear wall 67*g* of the upper transmission case 67 and the rear wall 68*b* of the lower transmission case 68). In this regard, the case oil passageway 111 is formed in the upper portion 67*b* of the upper transmission case 67 (opposed to the cooling water discharging passages 127, 127) and in the rear wall 61*b* (i.e., a sidewall) of the transmission case 61, which sidewall is located on the side of the cooling water discharging passages 127, 127. For this reason, a cooling water discharged out of the cooling water discharging passages 127, 127 can be guided along the case oil passageway 111, thereby cooling a lubricating oil introduced into the case oil passageway 111 with the result that the transmission 25 can be efficiently cooled.

A reason why the upper slanting portion 67*e* of the upper transmission case 67 provides a downward slope and the cooling water storing portion 72 and the shielding plate 77 are disposed on the upper slanting portion 67*e* will be discussed below with reference to FIG. 5 and FIG. 10.

As shown in FIG. 5 and FIG. 10, the cooling water storing portion 72 is disposed below the discharge ports 128, 128 of the cooling water discharging passages 127, 127. More specifically, the cooling water storing portion 72 is located in opposed relationship to the discharge ports 128, 128 of the cooling water discharging passages 127, 127 and has the introduction port 82 located rearwardly of the discharge ports 128, 128.

The shielding plate 77 is disposed rearwardly of the discharge ports 128, 128 of the cooling water discharging passages 127, 127, such that a cooling water discharged out of the discharge ports 128, 128 of the cooling water discharging passages 127, 127 can drop onto the upper slanting portion 67*e* of the upper transmission case 67 without being blocked by the shielding plate 77. The cooling water having dropped onto the upper slanting portion 67*e* can be guided along the upper slanting portion 67*e* through the introduction port 82 of the cooling water storing portion 72 into the cooling water storing portion 72 and stored in the cooling water storing portion 72.

When a predetermined amount of cooling water is stored in the cooling water storing portion 72, a level of the cooling water reaches the discharge openings 86. As the level of the cooling water reaches the discharge openings 86, the cooling water begins to be discharged out of the discharge openings 86. This allows the cooling water storing portion 72 to always store fresh cooling water.

Since the cooling water storing portion 72 is disposed on the upper slanting portion 67*e* of the upper transmission case 67 for storing an engine-cooling water in the cooling water storing portion 72, the upper slanting portion 67*e* of the upper transmission case 67 can be cooled by the engine-cooling water, and thus the transmission 25 can be cooled. The use of the engine-cooling water is a simple form to cool the transmission 25.

As shown in FIG. 10 and FIG. 11, the pair of exhaust pipes 33, 33 is disposed above the cooling water storing portion 72 and the shielding plate 77. The exhaust pipes 33, 33 have exhaust ports 34, 34 formed at lower end portions thereof, and the exhaust ports 34, 34 are located above the cooling water storing portion 72 and the shielding plate 77. The exhaust ports 34, 34 of the exhaust pipes 33, 33 are openings for discharging exhaust gas from the engine 22 (FIG. 1). Since the exhaust ports 34, 34 of the exhaust pipes 33, 33 are located above the shielding plate 77, it becomes possible to prevent exhaust gas discharged out of the exhaust ports 34, 34 from blowing against the upper slanting portion 67*e* of the upper transmission case 67 (the upper portion 67*b* of the upper transmission case 67) and a cooling water on the upper slanting portion 67*e*.

As shown in FIG. 1 and FIG. 10, the bevel gear mechanism 36 is connected to the output shaft 27 of the transmission 25, and accommodated in a gear chamber 155. Within the gear chamber 155, a lubricating oil having an oil level 156 having a height H1 is stored. The bevel gear mechanism 36 includes the pinion 37 disposed on the lower end portion 27*c* of (the lower half 27*b* of) the output shaft 27, and the bevel gear 38 meshing with a rear side of the pinion 37. Rotation of the bevel gear 38 brings a lubricating oil up to the pinion 37 so as to lubricate the bevel gear 38 and the pinion 37.

The bevel gear 38 is disposed on the propeller shaft 41 and the propeller 42 is disposed on the propeller shaft 41. Rotation of the crankshaft of the engine 22 rotates the output shaft 27 via the transmission 25. The rotation of the output shaft 27 rotates the propeller shaft 41 via the pinion 37 and the bevel gear 38. The propeller 41 then rotates the propeller 42.

The tapered roller bearing 44 supporting the upper portion 27*d* of the lower half 27*b* of the output shaft 27, and the roller bearing 45 supporting the vicinity of the lower end portion 27*c* of the lower half 27*b* are lubricated by the first lubrication means 47. The first lubrication means 47 includes a first oil pump 157 (an oil pump for the bevel gear mechanism) having an inlet communicating with the gear chamber 155, and a bevel guide oil passageway 158 communicating with an outlet of the first oil pump 157 and a location above the tapered roller bearing 44.

In the first lubrication means 47, the first oil pump 157 is driven to draw a lubricating oil in the gear chamber 155 into the first oil pump through the inlet of the first oil pump. The drawn lubricating oil is guided from the outlet of the first oil pump 157 through the bevel guide oil passageway 158 into the location above the tapered roller bearing 44. The lubricating oil guided to the location above the tapered roller bearing 44 falls under its own weight to thereby lubricate the tapered roller bearing 44. The lubricating oil having lubricated the tapered roller bearing 44 further falls under its own weight to thereby lubricate the roller bearing 45.

An example of lubricating the transmission 25 by the second lubrication means 65 will be discussed below with reference to FIG. 12A and FIG. 12B.

Figure 12A:
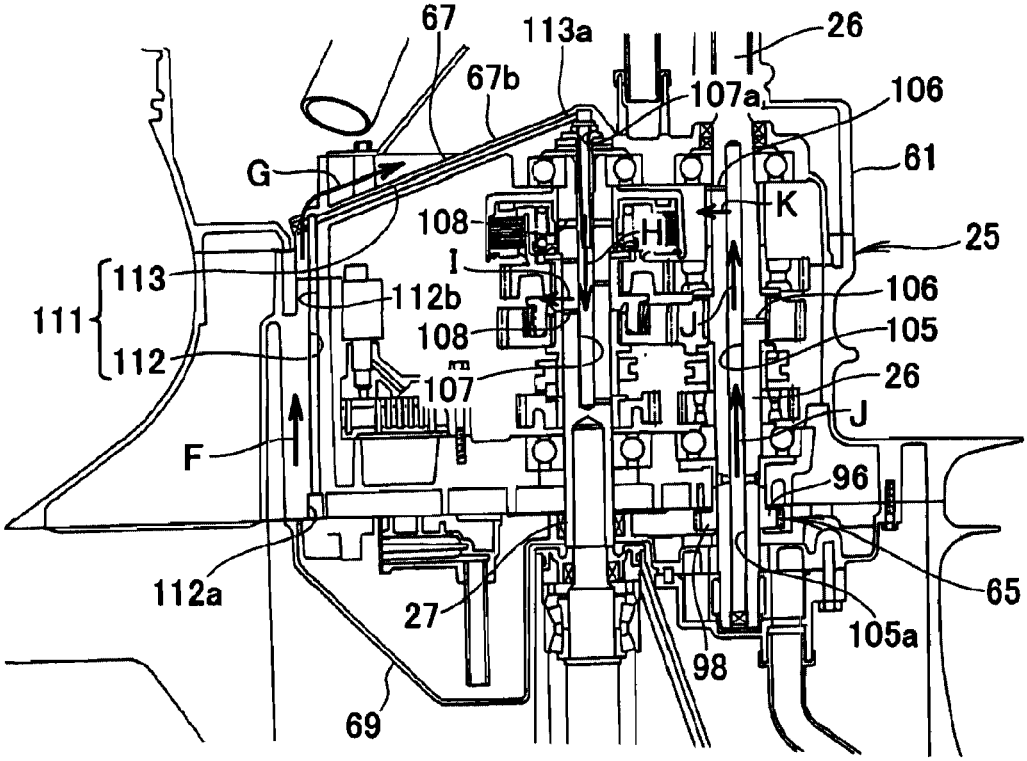
FIGS. 12A and 12B are views showing that the transmission is lubricated by second lubricating means.

As shown in FIG. 12A, since the drive gear 98 of the second oil pump 96 is disposed on the input shaft 26 of the transmission 25, the second oil pump 96 can be driven by the input shaft 26 for continuous forward rotation during forward or reverse propulsion, or stop of the hull 12 (FIG. 1).

The forward rotation of the second oil pump 96 draws a lubricating oil stored in the oil case 69 into the second oil pump 96. When the lubricating oil drawn into the second oil pump 96 is pumped out by the second oil pump 96, part of the lubricating oil pumped out is directed through the second case oil passageway 117 (FIG. 7) to the lower end portion 112*a* of the case oil passageway 111 (more specifically, the rear oil passageway 112).

The lubricating oil directed to the lower end portion 112*a* of the rear oil passageway 112 is guided along the rear oil passageway 112, as indicated by an arrow F, and reaches an upper end portion 112*b* of the rear oil passageway 112. The lubricating oil having reached the upper end portion 112*b* of the rear oil passageway 112 is guided along the upper oil passageway 113, as indicated by an arrow G, and reaches a front end portion 113*a* of the upper oil passageway 113.

The lubricating oil having reached the front end portion 113*a* of the upper oil passageway 113 is guided by the output shaft oil passageway 107 from an upper end portion 107*a* of the output shaft oil passageway 107, as indicated by an arrow H. The lubricating oil descends along the output shaft oil passageway 107, as indicated by the arrow H. During descent of the lubricating oil, the output shaft 27 rotates producing a centrifugal force. Under the centrifugal force, the lubricating oil in the output shaft oil passageway 107 jets from the plurality of output shaft jet ports 108, as indicated by an arrow I. The jetting lubricating oil lubricates the various lubrication parts within the transmission case 61.

The part of the lubricating oil pumped out by the second oil pump 96 is directed through the first case oil passageway 116 (FIG. 7) to the lower end portion 105*a* of the input shaft oil passageway 105. The lubricating oil directed to the lower end portion 105*a* of the input shaft oil passageway 105 ascends along the input shaft oil passageway 105, as indicated by an arrow J. During ascent of the lubricating oil, the input shaft 26 rotates producing a centrifugal force. Under the centrifugal force, the lubricating oil in the input shaft oil passageway 105 jets from the plurality of input shaft jet ports 106, as indicated by an arrow K. The jetting lubricating oil lubricates the various lubrication parts within the transmission case 61.

Figure 12B:
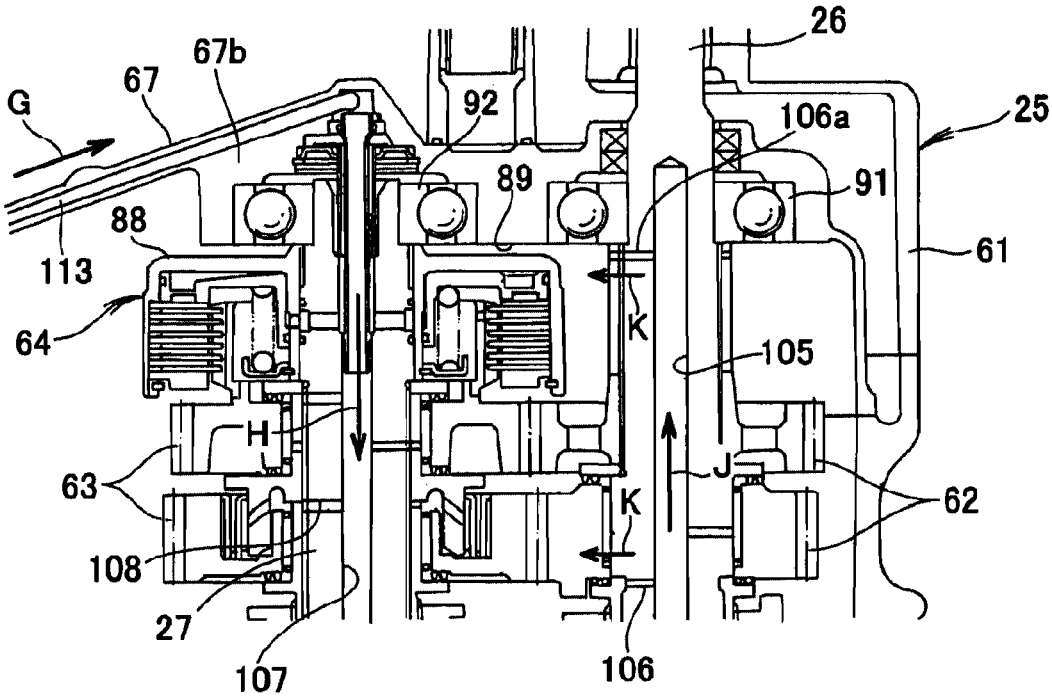

As shown in FIG. 12B, the uppermost one 106*a* of the plurality of input shaft jet ports 106 is opposed to the lubrication space 89 between the clutch housing 88 and the upper transmission case 67 (the upper portion 67*b*), such that the uppermost jet port 106*a* spouts a lubricating oil into the lubrication space 89, as indicated by an arrow K. The lubricating oil spouted into the lubrication space 89 produces a surface tension, providing a small area of contact between the lubricating oil and the clutch housing 88 or the upper portion 67*b*. The small contact area keeps a condition under which it is difficult for the lubricating oil to cling to both the clutch housing 88 and the upper portion 67*b*.

Under this condition, the clutch housing 88 rotates together with the output shaft 27, producing a centrifugal force. Under the centrifugal force, a lubricating oil clinging to the clutch housing 88 or the upper portion 67*b* can be well dispersed in the form of mist. That is, the lubricating oil, which clung to the clutch housing 88 or the upper portion 67*b*, can evenly reach the entire area of the inside of the transmission case 61.

Since the lubricating oil can successfully reaches the entire area of the inside of the transmission case 61, the various lubrication parts of the clutch 64 or the plurality of transmission gears 62, 63 accommodated in the transmission 25 can be well lubricated by an appropriate amount of lubricating oil.

The uppermost jet port 106*a* opens into the space below the input shaft bearing 91 and is located at the lower level than the output shaft bearing 92. Since the uppermost jet port 106*a* opens into the space below the input shaft bearing 91, a lubricating oil jets from the uppermost jet port 106*a* to the input shaft bearing 91. As a result, the input shaft bearing 91 can be well lubricated by the jetting lubricating oil.

The plurality of oil returning passages 103 is formed throughout the inside of the transmission case 61. Thus, after a lubricating oil dispersed throughout the inside of the transmission case 61 lubricates the various lubrication parts of the clutch 64 and the plurality of transmission gears 62, 63, the dispersed lubricating oil can be efficiently returned through the plurality of oil returning passages 103 into the oil case 69 (FIG. 12A).

As discussed above, the drive gear 98 of the second oil pump 96 is disposed on the input shaft 26 of the transmission 25. Thus, the second oil pump 96 can keep directing a lubricating oil to the various lubrication parts of the clutch 64 or the plurality of transmission gears 63, 64 to thereby keep lubricating the various lubrication parts of the clutch 64 or the plurality of transmission gears 63, 64 during forward or reverse propulsion, or stop of the hull 12.

An example of cooling the engine 22 and the transmission 25 by the cooling means 31 will be discussed below with reference to FIG. 13 and FIG. 14.

Figure 13:
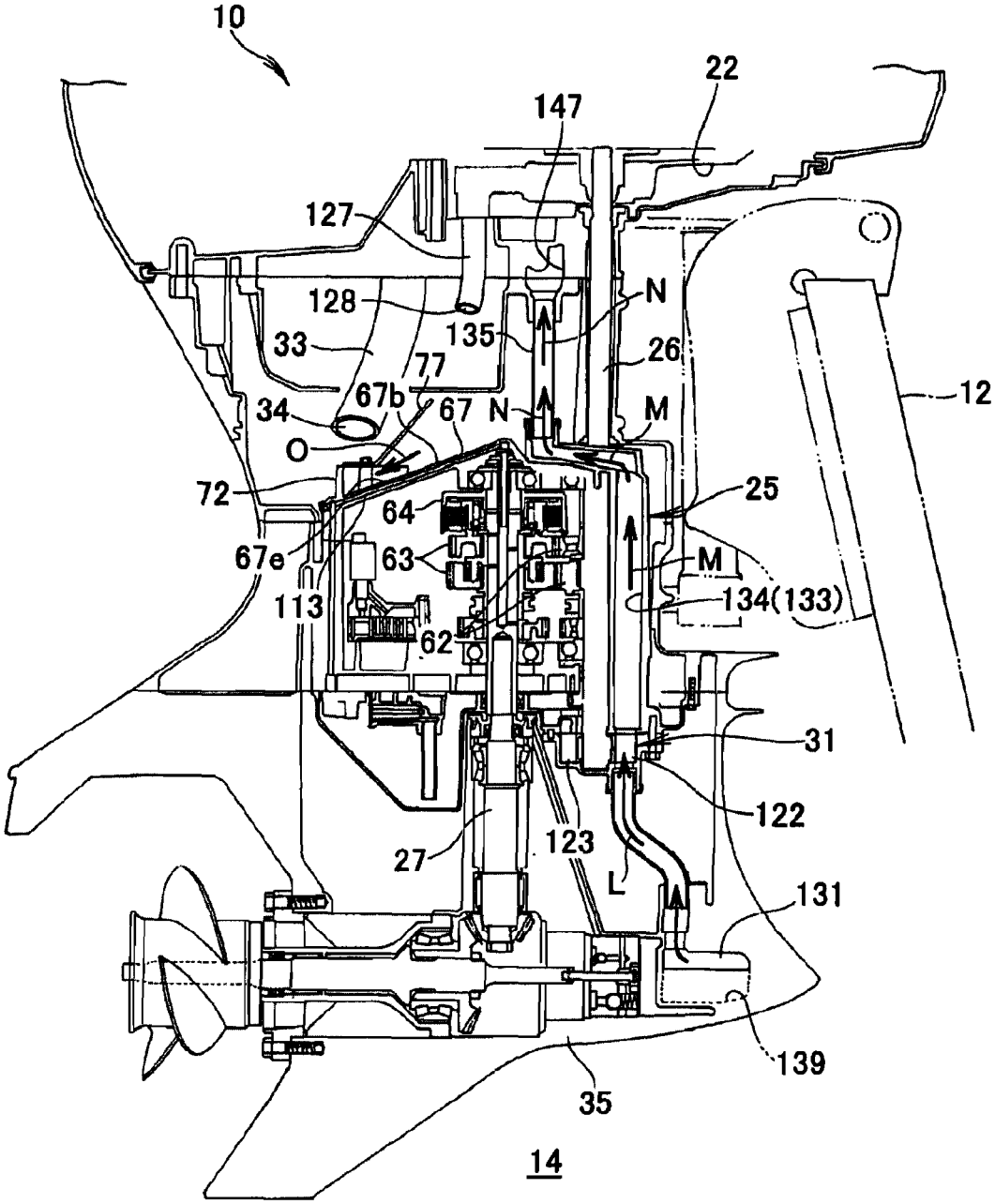
FIG. 13 is a view showing that an engine and the transmission are cooled by the cooling means.

As shown in FIG. 13, the drive gear 123 of the water pump 122 is disposed on the input shaft 26 of the transmission 25, whereby the water pump 122 can be driven by the input shaft 26 for continuous forward rotation during forward or reverse propulsion, or stop of the hull 12.

By the water pump 122 driven by the input shaft 26 for forward rotation, a cooling water can be drawn from the outside 14 of the outboard engine unit 14 through the left and right inlet ports 139 of the lower case 35 into the drawing portion 131.

Figure 14:
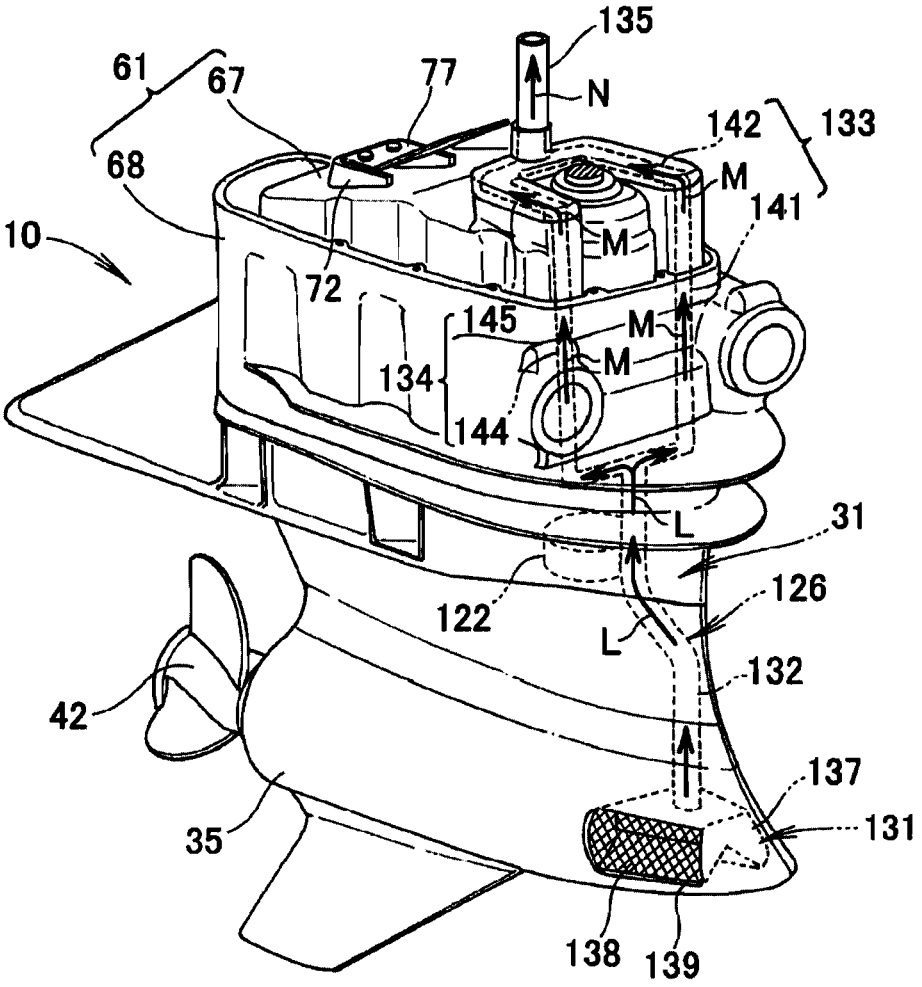
FIG. 14 is a perspective view of the cooling means directing a cooling water.

As shown in FIG. 14, the cooling water drawn into the drawing portion 131 is directed via the drawing passage 132 into the left and right feeding passages 133, 134, as indicated by an arrow L. The cooling water is then guided along the left and right feeding passages 133, 134, as indicated by arrows M, M.

As shown in FIG. 13, the plurality of transmission gears 62 (i.e., the transmission 25) can be efficiently cooled by a cooling water flowing along the left and right feeding passages 133, 134, as indicated by the arrow M. The cooling water having flowed along the left and right feeding passages 133, 134 is directed through the guide passage 135 into the water jacket inlet 147 of the engine 22, as indicated by an arrow N. The engine 22 can be cooled by the cooling water directed into the water jacket.

The cooling water having cooled the engine 22 is discharged out of the discharge ports 128 of the cooling water discharging passages 127 and drops onto the upper portion of the transmission 25 (more specifically, the upper slanting portion 67*e* of the upper transmission case 67). After dropping onto the upper slanting portion 67*e* of the upper transmission case 67, the cooling water is guided along the upper slanting portion 67*e*, as indicated by an arrow O. As a result, the transmission 25 can be cooled by the cooling water guided along the upper slanting portion 67*e* of the upper transmission case 67.

Since the cooling water storing portion 72 is disposed on the upper slanting portion 67*e* of the upper transmission case 67, the cooling water guided along the upper slanting portion 67*e* is stored in the cooling water storing portion 72. Thus, the upper slanting portion 67*e* of the upper transmission case 67 and hence the transmission 25 can be well cooled by the cooling water stored in the cooling water storing portion 72.

As discussed above, since the drive gear 123 of the water pump 122 is disposed on the input shaft 26 of the transmission 25, the water pump 122 can keep directing a cooling water to the engine 22 and the transmission 25. As a result, it becomes possible to keep cooling the engine 22 and the transmission 25 by the cooling water during forward or reverse propulsion, or stop of the hull 12.

The upper oil passageway 113 is formed in the upper slanting portion 67*e* of the upper transmission case 67. The upper oil passageway 113 is an oil passageway for guiding a lubricating oil for the transmission 25. A lubricating oil in the upper oil passageway 113 can be well cooled by an engine-cooling water stored in the cooling water storing portion 72.

Since the exhaust ports 34 of the exhaust pipes 33 are disposed above the shielding plate 77, it becomes possible to prevent exhaust gas discharged out of the exhaust ports 34 from blowing against the upper slanting portion 67*e* of the upper transmission case 67. As a result, it becomes possible to prevent the upper slanting portion 67*e* of the upper transmission case 67 from being heated by exhaust gas and hence the transmission case 25 can be well cooled.

Since the shielding plate 77 is positioned on the top part of the cooling water storing portion 72, a cooling water stored in the cooling water storing portion 72 can be protected from exhaust gas.

It is to be noted that the outboard engine unit according to the present invention is not limited to that discussed in the embodiment, but may be appropriately changed or modified. For example, the outboard engine unit 10, the engine 22, the transmission 25, the input shaft 26, the output shaft 27, the exhaust pipes 33, the exhaust ports 34, the propeller shaft 41, the transmission case 61, the plurality of transmission gears 62, 63, the upper transmission case 67, the upper portion 67*b* of the upper transmission case, the cooling water storing portion 72, the shielding plate 77, the horizontal attachment portion 77*a*, the opening 81 of the cooling water storing portion (the top part of the cooling water storing portion), the case oil passageway 111, the upper oil passageway (the lubricating oil passageway) 113, the water pump 122, the cooling water discharging passages 127, the discharge ports 128, the left and right feeding passages 133, 134, the water jacket inlet 147, the water jacket outlet 148 and the like have their shapes or structures which are not limited to those discussed in the embodiment but may be appropriately changed or modified.

The present invention is preferably applicable to an outboard engine unit having a transmission having an input shaft connected to an engine and an output shaft connected via a bevel gear mechanism to a propeller shaft.

Obviously, various minor changes and modifications of the present invention are possible in the light of the above teaching. It is therefore to be understood that within the scope of the appended claims the invention may be practiced otherwise than as specifically described.

What is claimed is:

1. An outboard engine unit including an engine, a transmission, and a propeller shaft, the transmission having an input shaft connected to the engine and an output shaft connected to the propeller shaft, the outboard engine unit comprising:

a water pump disposed on an end portion of the input shaft for drawing a cooling water from an outside of the outboard engine unit;

a plurality of cooling water feeding passages interconnecting the water pump and a cooling water inlet of the engine for directing the cooling water drawn by the water pump to the cooling water inlet;

the plurality of cooling water feeding passages being disposed around a plurality of transmission gears disposed on the input shaft of the transmission;

a cooling water discharging passage communicating with a cooling water outlet of the engine for discharging from the engine a cooling water having cooled the engine, the cooling water discharging passage being disposed above the transmission and rearwardly of the output shaft of the transmission; and a lubricating oil passageway for directing a lubricating oil to lubricate the transmission, wherein the transmission comprises a case including a sidewall facing the cooling water discharging passage, and an upper portion opposed to the cooling water discharging passage, and the lubricating oil passageway is disposed along the sidewall and the upper portion.

2. An outboard engine unit including an engine, a propeller shaft, and a transmission interposed between the engine and the propeller shaft, the transmission including a case disposed below the engine, the outboard engine unit comprising:

a discharge port disposed above the case for discharging a cooling water having cooled the engine;

a cooling water storing portion disposed on an upper portion of the case in opposed relationship to the discharge port for storing the cooling water.

an exhaust port disposed above the case for discharging an exhaust gas from the engine; and a shielding plate disposed on a top part of the cooling water storing portion for preventing the exhaust gas from blowing against the upper portion of the case.

3. The outboard engine unit of claim 2, further comprising a lubricating oil passageway formed in the upper portion of the case for directing a lubricating oil to lubricate the transmission.

4. An outboard engine unit comprising:

an engine having a cooling water inlet and a cooling water outlet;

a propeller shaft;

a transmission interposed between the engine and the propeller shaft;

the transmission including a transmission case disposed below the engine, an input shaft rotatably supported by the transmission case in vertical orientation and having an upper end connected to the engine, an output shaft rotatably supported by the transmission case in vertical orientation and having a lower end connected to the propeller shaft, a plurality of transmission gears mounted on the input shaft, and a plurality of transmission gears mounted on the output shaft;

the transmission case having a front wall, a rear wall and a top wall connecting upper ends of the front wall and the rear wall;

the input shaft being located closer to the front wall of the transmission case than the rear wall of the transmission case, the output shaft being spaced rearwardly from the input shaft by a predetermined interval, and the output shaft being connected to the input shaft via the transmission gears mounted on the input shaft and the output shaft, respectively;

a water pump provided on a lower end portion of the input shaft for drawing a cooling water from an outside of the outboard engine unit;

a plurality of cooling water feeding passages interconnecting the water pump and the cooling water inlet of the engine for directing the cooling water drawn by the water pump to the cooling water inlet; and the plurality of cooling water feeding passages being arranged to surround the transmission gears mounted on the input shaft of the transmission, wherein the plurality of cooling water feeding passages include vertical cooling water feeding passages formed in opposite lateral sides of the front wall of the transmission case, and horizontal cooling water feeding passages formed in opposite lateral sides of the top wall of the transmission case at a front part of the top wall, each of the horizontal cooling water feeding passages having one end connected to an upper end of a corresponding one of the vertical cooling water feeding passages and an opposite end extended in a lateral inward direction to merge with an opposite end of another horizontal cooling water feeding passage on a rearward side of the input shaft of the transmission.

5. The outboard engine unit of claim 4, further comprising:

a cooling water discharging passage communicating with the cooling water outlet of the engine for discharging from the engine a cooling water having cooled the engine, wherein the cooling water discharging passage is disposed above a rear part of the top wall of the transmission case and having a discharge port located rearwardly of the output shaft of the transmission.

6. The outboard engine unit of claim 5, further comprising:

a lubricating oil passageway for directing a lubricating oil to lubricate the transmission, the lubricating oil passageway being formed in the rear wall and a rear part of the top wall of the transmission case.

7. The outboard engine unit of claim 5, further comprising:

a cooling water storing portion disposed on the top wall of the transmission case in vertically opposed relationship to the discharge port of the cooling water discharge passageway and configured to temporarily store the cooling water.

8. The outboard engine unit of claim 7, further comprising:

an exhaust port disposed above the transmission case for discharging an exhaust gas from the engine; and a shielding plate disposed on a top part of the cooling water storing portion for preventing the exhaust gas from blowing against an upper portion of the case.

9. The outboard engine unit of claim 6, further comprising:

a cooling water storing portion disposed on the top wall of the transmission case in vertically opposed relationship to the discharge port of the cooling water discharge passageway and configured to temporarily store the cooling water.

10. The outboard engine unit of claim 9, further comprising:

an exhaust port disposed above the transmission case for discharging an exhaust gas from the engine; and a shielding plate disposed on a top part of the cooling water storing portion for preventing the exhaust gas from blowing against an upper portion of the case.

* * * * *